US005248862A

United States Patent [19]

Blatter

[11] Patent Number: 5,248,862

[45] Date of Patent: Sep. 28, 1993

[54] GAS-BLAST CIRCUIT BREAKER

[75] Inventor: Johannes Blatter, Gretzenbach, Switzerland

[73] Assignee: Sprecher Energie AG, Oberentfelden, Switzerland

[21] Appl. No.: 855,680

[22] Filed: Mar. 23, 1992

[30] Foreign Application Priority Data

Apr. 12, 1991 [CA] Canada ..... 01103/91

[51] Int. Cl.[5] ..... H01H 33/91

[52] U.S. Cl. ..... 200/148 A; 200/148 F; 200/148 H

[58] Field of Search ..... 200/148 R, 148 A, 148 F, 200/148 H

[56] References Cited

U.S. PATENT DOCUMENTS

| | | | |
|---|---|---|---|
| 4,276,456 | 6/1981 | Cromer et al. | 200/148 A |
| 4,880,946 | 11/1989 | Thuries et al. | 200/148 A |
| 4,983,789 | 1/1991 | Thuries | 200/148 A |
| 5,162,627 | 11/1992 | Dufournet et al. | 200/148 A |

FOREIGN PATENT DOCUMENTS

| | | |
|---|---|---|
| 456139 | 11/1991 | European Pat. Off. . |
| 1313825 | 3/1990 | Japan . |
| 2250227 | 12/1990 | Japan . |

*Primary Examiner*—A. D. Pellinen
*Assistant Examiner*—Michael A. Friedhofer
*Attorney, Agent, or Firm*—Keck, Mahin & Cate

[57] ABSTRACT

In a gas-blast circuit breaker, compressed gas is directed through a movable contact maker into a blow-out space, the latter being delimited by a cylinder and a piston which is operatively associated with the movable contact maker. The piston comprises inlet openings which are releasably closed by means of a valve body. At a neck or collar of the piston there is displaceably mounted an actuating element, the latter being reciprocatingly movable between a lower first lock-in position and an upper second lock-in position. The actuating element comprises a nose or lug which, during the closing operation, abuts against an upper stop face or surface, whereby the actuating element is brought into the lower first lock-in position. The valve body thereby moves into the closed position thereof. Towards the end of the opening stroke, a shaft associated with the actuating element comes to bear upon a lower stop face or surface, so that the actuating element is brought back to the upper second lock-in position thereof, whereby the valve body is returned to and retained in its open position. The blow-out space is thus connected with the ambient space during the closing operation and again separated from the ambient space prior to the opening or tripping operation. The driving mechanism of the circuit breaker is assisted during the interruption of relatively high-amperage currents and no additional driving effort is required of the driving mechanism during the closing operation and the interruption of relatively low-amperage currents. The gas-blast circuit breaker thus gets by with a driving mechanism of relatively low operating power.

28 Claims, 3 Drawing Sheets

GAS-BLAST CIRCUIT BREAKER

BACKGROUND OF THE INVENTION

The present invention broadly relates to circuit breakers or interrupters and pertains, more specifically, to a new and improved gas-blast circuit breaker.

Generally speaking, the gas-blast circuit breaker of the present invention performs a closing operation and an opening operation to assume a closed-circuit position and an open-circuit position, respectively, and is of the type comprising a stationary contact piece and a movable contact maker which are arranged in an ambient space comprising a quenching gas. The movable contact maker is provided with an axial passage starting at the free end of the latter and is encompassed by a blast nozzle which in the closed-circuit position is penetrated by the stationary contact piece. The port of the blast nozzle communicates with a pumping space which can be pressurized during an opening stroke and is delimited by a pumping cylinder and a pumping piston, whereby the axial passage at the end remote from the free end of the movable contact maker opens into a blow-out space which is delimited by a cylinder and a piston, the latter being operatively associated with the movable contact maker. The blow-out space is connectable with the ambient space during the closing operation by means of controlled valve means.

Such type of gas-blast circuit breaker is known, for instance, from European Patent Application No. 0,380,907, published Aug. 8, 1990. In the circuit breaker disclosed therein, the quenching gas flowing into a blow-out space assists the driving mechanism during the interruption of relatively high-amperage currents. In order to avoid, during the closing operation, an overpressure requiring additional driving effort of the driving mechanism, there are provided cylindrical slide-valve means which during the closing stroke, as a result of the thereby generated relatively high excess pressure in the blow-out space with respect to a slight negative pressure in the pumping space, release radially extending openings provided in a cylinder delimiting the blow-out space, so that excess pressure can vent through the radially extending openings and thus ensure pressure compensation between the blow-out space and the ambient space or gas plenum. In order to control the slide-valve means, there is provided a control piston in the pumping piston separating the pumping space from the blow-out space. In order that the driving mechanism need not provide more driving energy during the interruption of relatively low-amperage currents than in a circuit breaker without a blow-out space, a piston delimiting the blow-out space and operatively associated with the movable contact maker is provided with a large-surface check valve, the latter remaining open because the pressure increase due to the established arc is insufficient to press the valve body or disk against its seat.

This known gas-blast circuit breaker is not only disadvantageous in that a certain requisite pressure difference between the pressure in the pumping space and the pressure in the blow-out space has to be first built up, in order to open the aforesaid slide-valve means, such pressure difference build-up requiring driving energy, but also for the reason that —at the start of the downward opening or tripping stroke—the slide-valve means have to be first brought again to the closed position thereof, whereby the pumping space is enlarged by the thereby effected displacement of the control piston. As a result, the generated pressure in the pumping space is decreased, thus impairing the interrupting capacity of the circuit breaker. Furthermore, slide-valve means as provided in the prior art construction require a corresponding constructional expenditure and substantially increase the manufacturing costs of the circuit breaker.

SUMMARY OF THE INVENTION

Therefore, with the foregoing in mind, it is a primary object of the present invention to provide a new and improved construction of a gas-blast circuit breaker which does not exhibit the drawbacks and shortcomings of the prior art constructions.

In keeping with the immediately preceding object, it is a further object of the present invention to provide a new and improved gas-blast circuit breaker which is relatively simple in construction and design and comprises substantially improved switching characteristics, and in which the driving mechanism during the closing operation or process of the circuit breaker performs no more work than in a circuit breaker having no blow-out space.

Yet a further significant object of the present invention aims at providing a new and improved construction of a gas-blast circuit breaker which permits using the simplest possible means requiring a minimum of space, and which is relatively economical to manufacture and yet affords highly reliable operation thereof without being subject to malfunction and breakdown.

Now in order to implement these and still further objects of the present invention, which will become more readily apparent as the description proceeds, the gas-blast circuit breaker of the present invention is manifested, among other things, by the features that control means are provided for opening the controlled valve means towards the end of the opening stroke and for retaining open the controlled valve means during the closing operation until the closed position is substantially reached.

The controlled valve means are advantageously controlled in dependence on the stroke or travel of the movable contact maker. In this manner, an influence on the pumping space and the build-up of pressure for actuating the controlled valve means are precluded.

In a particularly preferred exemplary embodiment of the gas-blast circuit breaker constructed according to the invention, the controlled valve means comprise a valve body or disk, and the control means comprise (a) an actuating element which is movable in the direction of travel of the piston and can be brought to act upon the aforesaid valve body, and (b) a snap-in locking device having a first lock-in position and a second lock-in position for the actuating element, whereby the closed position of the valve body corresponds with the first lock-in position and the open position of the valve body corresponds with the second lock-in position. The actuating element is displaceable from the first lock-in position into the second lock-in position by impacting against first stop means towards the end or at the end of the opening stroke. During the closing operation, the actuating element is displaceable from the second lock-in position into the first lock-in position by impacting against second stop means shortly before or upon reaching the closed position of the circuit breaker.

The first stop means and the second stop means are preferably stationary.

A particularly simple and preferred embodiment of the gas-blast circuit breaker constructed according to the invention comprises a drag connection means for coupling the valve body with the actuating element such that the valve body in the aforesaid first lock-in position, which corresponds with the closed position of the valve body, forms a flutter valve having free passage in the direction from the ambient space into the blow-out space. In this manner, negative pressure in the blow-out space with respect to the ambient space is precluded, thus ensuring that the driving mechanism during low-amperage interruption performs no more work than in circuit breakers having no blow-out space.

According to a likewise simple exemplary embodiment the blow-out space is connected to the ambient space by means of check-valve means having free passage in the direction from the ambient space into the blow-out space. This construction likewise ensures that during the interruption of relatively low-amperage currents no additional driving effort is needed in comparison with a gas-blast circuit interrupter without a blow-out space.

According to a further embodiment of the circuit breaker constructed according to the present invention there is provided an arrangement wherein the actuating element is disposed within the blow-out space and structured to have a substantially ring-shaped configuration, thereby encompassing the movable contact maker or a neck or collar formed at the piston. The snap-in locking device provided in the movable contact maker or in the aforesaid neck or collar of the piston, as the case may be, comprises a spring-biased snap-in member, preferably a spring-biased ball, which coacts with two detent grooves provided at the actuating element.

The actuating element advantageously comprises a counterstop means which piercingly extends through the piston and coacts with the aforesaid first stop means preferably provided externally of the blow-out space. The second stop means can be located in the blow-out space.

An advantageous embodiment is realized by providing the snap-in locking device with magnetic means serving to retain the actuating element in the first lock-in position or, as the case may be, in the second lock-in position.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters and numerals to denote the same or analogous components and wherein.

DETAILED DESCRIPTION OF THE PREFERRED EMBODIMENTS

Describing now the drawings, it is to be understood that to simplify the showing thereof, only enough of the construction of the gas-blast circuit breaker has been illustrated therein as is needed to enable one skilled in the art to readily understand the underlying principles and concepts of this invention.

Figure 1:
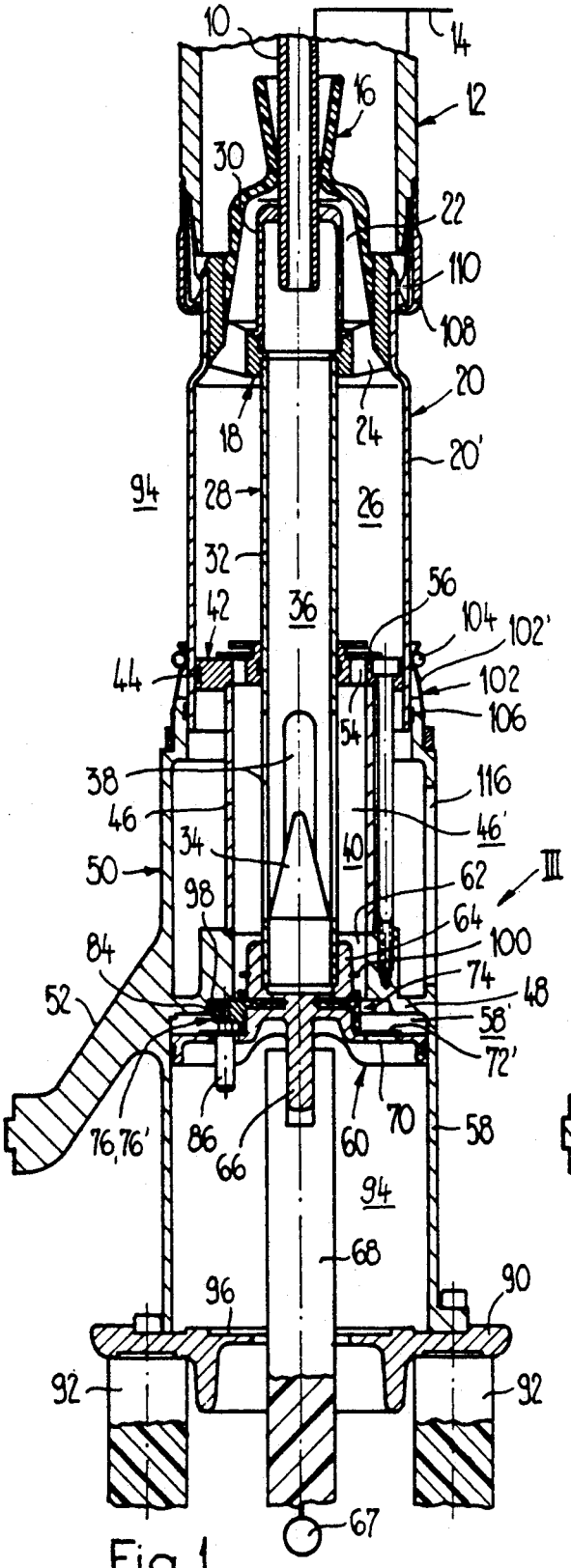
FIG. 1 schematically shows in a fragmentary axial or longitudinal sectional view a first exemplary embodiment of a gas-blast circuit breaker constructed according to the invention and shown in its closed-circuit position.
Figure 2:
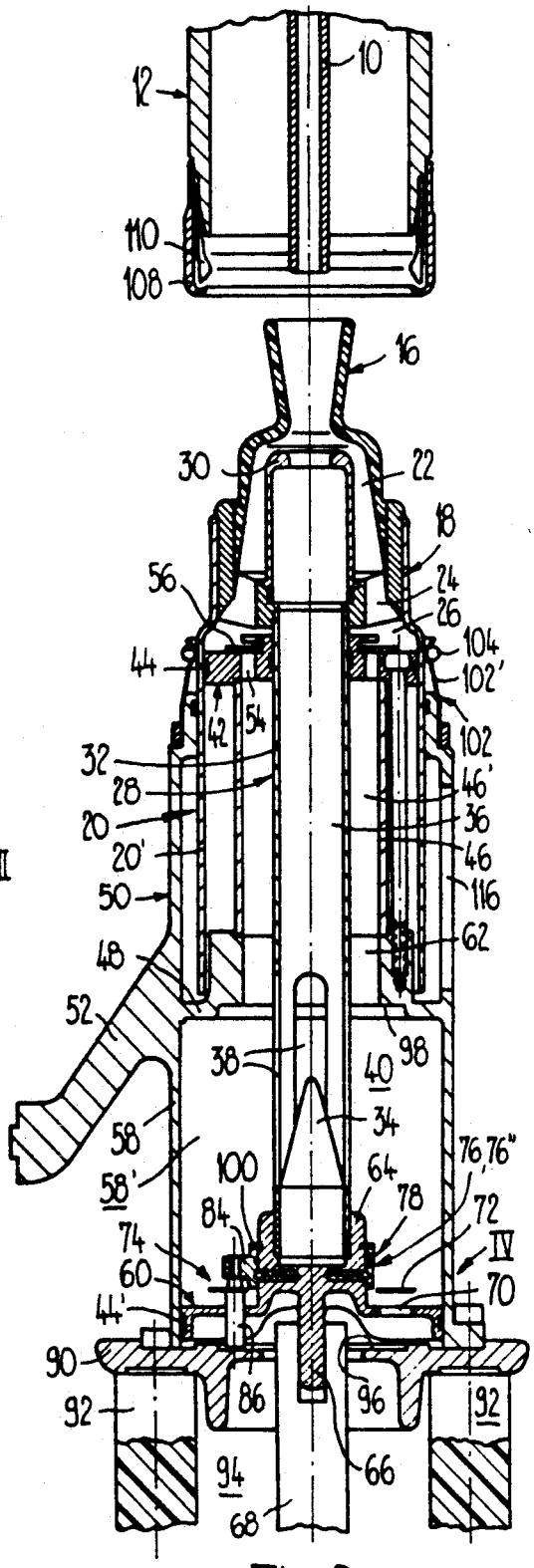
FIG. 2 schematically shows the first exemplary embodiment of the gas-blast circuit breaker in an axial view corresponding to that of FIG. 1, with the difference that here the gas-blast circuit breaker is illustrated in its open-circuit position.

Turning attention now specifically to FIGS. 1 and 2 of the drawings, the gas-blast circuit breaker illustrated therein by way of example and not limitation will be seen to comprise a stationary contact piece 10 placed in parallel with a likewise stationary constant-current contact piece 12, the latter coaxially surrounding the stationary contact piece 10 which is connected in generally known manner to a terminal or conductor 14 of the gas-blast circuit breaker. This terminal 14 is schematically depicted solely in FIG. 1 of the drawings.

In the closed position of the gas-blast circuit breaker as depicted in FIG. 1. the stationary contact piece 10 closes a blast nozzle 16 formed of a suitable insulating material. This blast nozzle 16 is mounted at a base 18 of a metallic pumping cylinder 20 which is open in the downward direction, and comprises a port or entrance 22 communicating with a pumping space 26 by means of flow passages 24 provided in the base 18. The pumping space 26 is enclosed by the pumping cylinder 20 comprising a metallic cylinder jacket 20', the base 18 being mounted at the latter in the upper end region thereof. The base 18 and thus the metallic pumping cylinder 20 are firmly anchored at a movable contact maker 28 comprising a tulip-like arcing contact piece 30 located above the base 18.

In the closed position (FIG. 1) of the gas-blast circuit breaker, the tulip-like arcing contact piece 30, hereinafter referred to as the tulip contact 30, embraces and coacts with the stationary contact piece 10. The tulip contact 30 delimits, at the inner side as viewed in the radial direction, the port or entrance 22 of the blast nozzle 16. Furthermore, the movable contact maker 28 comprises a blow-out or exhaust pipe 32 which is closed at the lower end thereof by a plug 34, the latter being tapered in the direction towards the interior of the blow-out or exhaust pipe 32. The tulip contact 30 and the blow-out or exhaust pipe 32 thus enclose a passage or duct 36 starting from the upper free end of the movable contact maker 28 and extending in the axial direction of the circuit breaker, whereby the passage or duct 36 piercingly extends through the base 18. The length of the passage or duct 36 is limited by the plug 34. The passage 36 opens into a blow-out space 40 through radial openings 38 provided in the blow-out or exhaust pipe 32.

The pumping space 26 is delimited, on the side remote from the base 18, by a stationary annular pumping piston 42, the latter sealingly encompassing the blow-out or exhaust pipe 32 at a location above the radial openings 38. The stationary ring-shaped pumping piston 42 comprises a circumferential groove, in which there is accommodated a piston ring 44 formed of a suitable plastics material, at which the metallic cylinder jacket 20' is slidingly mounted. The stationary annular pumping piston 42 bears upon a supporting tube 46 encompassing at a distance the blow-out or exhaust pipe 32. In turn, the supporting tube 46 is supported at its lower end by an intermediate base or bottom 48 of a substantially cylindrically formed second constant-current contact piece 50. A terminal flange 52 juts out from this second constant-current contact piece 50, in order to ensure the electrical connection to the not particularly illustrated but conventional other terminal of the gas-blast circuit breaker.

The pumping space 26 and the blow-out space 40 communicate by means of aspiration passages 54 provided in the stationary annular pumping piston 42. The aspiration passages 54 are releasably closed by a ring-shaped check-valve body 56 coacting with the stationary annular pumping piston 42. The ring-shaped check-valve body 56 forms together with the stationary annular pumping piston 42 a flutter valve, the latter opening when excess pressure prevails in the blow-out space 40 with respect to the pressure prevailing in the pumping space 26.

The region of the second constant-current contact piece 50 located below the intermediate base or bottom 48 forms a cylinder 58, in which a piston 60 is appropriately mounted to be slidably displaceable. The piston 60 comprises a circumferential groove in which a piston ring 44' is accommodated, in order to provide sealing between the cylinder 58 and the piston 60. In the intermediate base or bottom 48 forming the base of the cylinder 58, there is provided a connecting opening 62 extending in the axial direction, the inside diameter of which is in alignment with the inside diameter of the supporting tube 46. In this manner, the connecting opening 62 connects a partial space or section 46' delimited by the supporting tube 46 and at the top by the stationary annular pumping piston 42 with a partial space or section 58' delimited by the cylinder 58 and the piston 60. The blow-out space 40 is thus composed of the two partial spaces 46' and 58'.

At the piston 60 there is integrally formed an upwards projecting neck or collar 64, into which the lower end portion of the blow-out or exhaust pipe 32 is threadably secured. At the piston side remote from the aforesaid neck or collar 64, there is integrally formed a connecting nose or rod 66 projecting downwardly from the piston 60. An insulated operating rod 68 formed of a suitable plastics material is appropriately coupled to the connecting nose or rod 66 and connected with a driving or operating mechanism 67 forming no part of the present invention and schematically depicted solely in FIG. 1.

Figure 3:
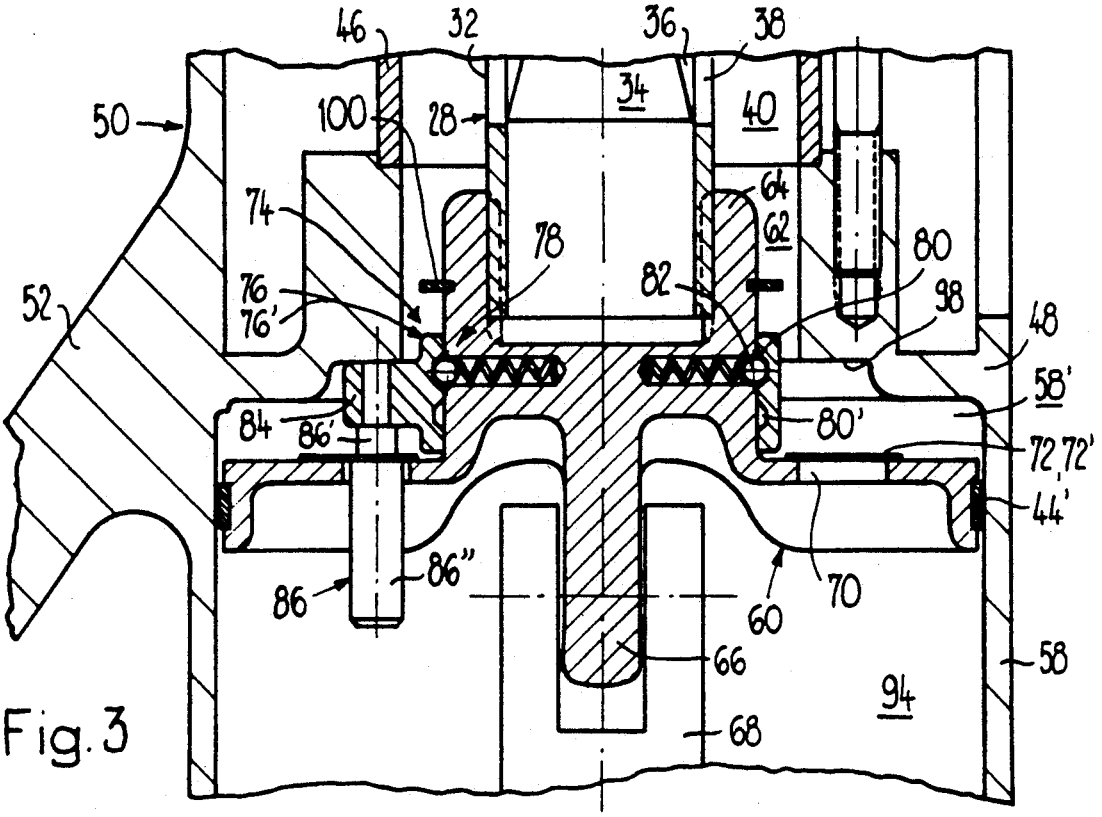
FIG. 3 schematically shows on an enlarged scale in relation to FIG. 1 the circuit-breaker region designated by the arrow III in FIG. 1.
Figure 4:
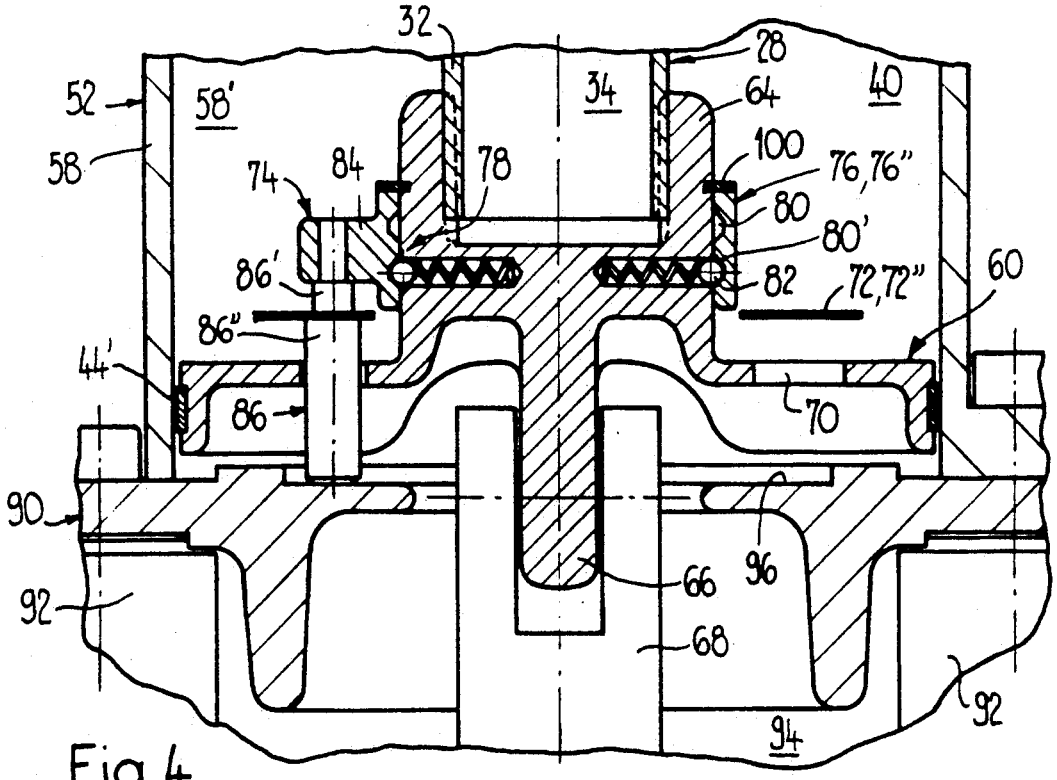
FIG. 4 schematically shows on an enlarged scale in relation to FIG. 2 the circuit-breaker region designated by the arrow IV in FIG. 2.

As will be particularly recognized from the illustration in FIGS. 3 and 4, large-surface inlet or admission openings 70 are provided in the piston 60. These inlet openings 70 are closable by means of a disk-type annular valve body 72 which encompasses the neck or collar 64 at a relatively short spacing and coacts with the piston 60. Appropriate control means 74 are provided to control the disk-type annular valve body 72 such that the latter comes to bear in its closed position 72' upon the piston 60 at the side thereof facing the blow-out space 40, as depicted in FIGS. 1 and 3, or is retained in its open position designated by reference numeral 72'', as depicted in FIGS. 2 and 4.

An annular actuating or operating element 76 of the aforesaid control means 74 encompasses the neck or collar 64 of the piston 60 and is displaceably guided thereat in the axial direction. A snap-in locking device 78 of the control means 74 defines a lower first lock-in position 76' (FIGS. 1 and 3) and an upper second lock-in position 76'' (FIGS. 2 and 4) for the annular actuating or operating element 76. For this purpose, the annular actuating or operating element 76 comprises two circumferential detent grooves 80 and 80' arranged in a spaced relationship to one another in the axial direction, whereby the spacing between the two detent grooves 80 and 80' corresponds with the distance between the lower first lock-in position 76' and the upper second lock-in position 76''. The circumferential detent grooves 80 and 80' in the annular actuating or operating element 76 co-act with snap-in balls 82 provided in the neck or collar 64 of the piston 60, the snap-in balls 82 being displaceable in the radial direction and pre-biased in the outward direction.

As shown in FIGS. 1 through 4, noses or lugs 84 jut out from the annular actuating or operating element 76, whereby in each of the Figures only one nose 84 is shown. At each nose 84 there is mounted a shaft or shank 86 which extends in the axial direction and is stepped in its diameter. A small-diameter shaft portion 86', located adjacent the related nose or lug 84, reaches through the disk-type annular valve body 72, while a large-diameter shaft portion 86'' piercingly extends through the piston 60. The stepped construction of the shaft or shank 86 forms a drag connection between the disk-type annular valve body 72 and the annular actuating or operating element 76.

When the annular actuating or operating element 76 is in its lower first lock-in position 76' (FIGS. 1 and 3), the disk-type annular valve body 72 closes the large-surface inlet or admission openings 70. The distance between the lower edge of the noses or lugs 84 and the disk-type annular valve body 72 in its closed position 72' allows the latter to act as a flutter valve or a pressure relief valve. However, when the annular actuating element 76 assumes its upper second lock-in position 76'' (FIGS. 2 and 4), the drag connection will ensure by virtue of the step in the shaft or shank 86 between the small-diameter shaft portion 86' and the large-diameter shaft portion 86'' that the disk-type annular valve body 72 is retained in the open position 72'' thereof.

The second constant-current contact piece 50 is mounted with its lower end at a ring-shaped retaining or supporting flange 90, the latter encompassing the insulated operating rod 68 at a relatively small spacing and being supported by means of support insulators 92 at a not particularly illustrated circuit-breaker housing. Such housing encloses an ambient space 94, in which all hereinbefore described parts or components are arranged and in which there is provided a quenching gas under higher pressure than atmospheric, for instance sulfur hexafluoride gas ($SF_6$), which exhibits outstanding arc quenching and insulation properties. Naturally, other suitable gases may be employed.

At the ring-shaped retaining or supporting flange 90 there is formed, at its side facing the piston 60, a first stop face or surface 96 which co-acts with the respective lower ends of the shafts 86 acting as the first counterstops. In a similar manner, there is provided at the intermediate base or bottom 48, namely on the side thereof facing the piston 60, a second stop face or surface 98 which co-acts with the noses 84 acting as the second counterstops. The piston 60 and a lock washer 100 or equivalent structure mounted at the neck 64 ensure that the annular actuating or operating element 76 operatively associated for co-movement with the piston 60 can be reciprocatingly shifted solely between the lower first lock-in position 76' and the upper second lock-in position 76''.

At the upper end of the second constant-current contact piece 50, i.e. approximately at the level of the stationary annular pumping piston 42, there is mounted a crown-like sliding contact piece 102 comprising self-resilient contact fingers 102' which, under the additional action of a spring 104 encompassing the latter, bear upon the metallic cylinder jacket 20'. For the purpose of guiding the metallic pumping cylinder 20, there is provided a slide ring 106 in the upper end region of the second constant-current contact piece 50 encompassing the metallic pumping cylinder 20.

The stationary constant-current contact piece 12 comprises at its lower end region, the latter facing the metallic pumping cylinder 20, resiliently formed constant current contact fingers 110 covered or concealed by a hood 108 and co-acting with the metallic pumping cylinder 20.

Figure 5:
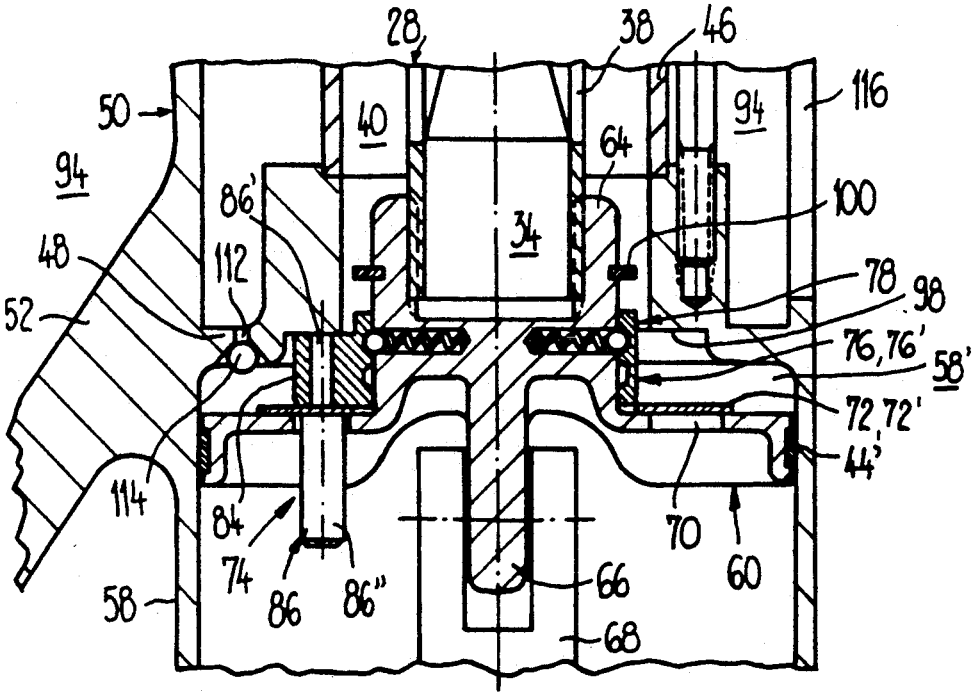
FIG. 5 schematically shows in a view corresponding to that in FIG. 3 a part or portion of a second exemplary embodiment of the gas-blast circuit breaker constructed according to the invention.
Figure 6:
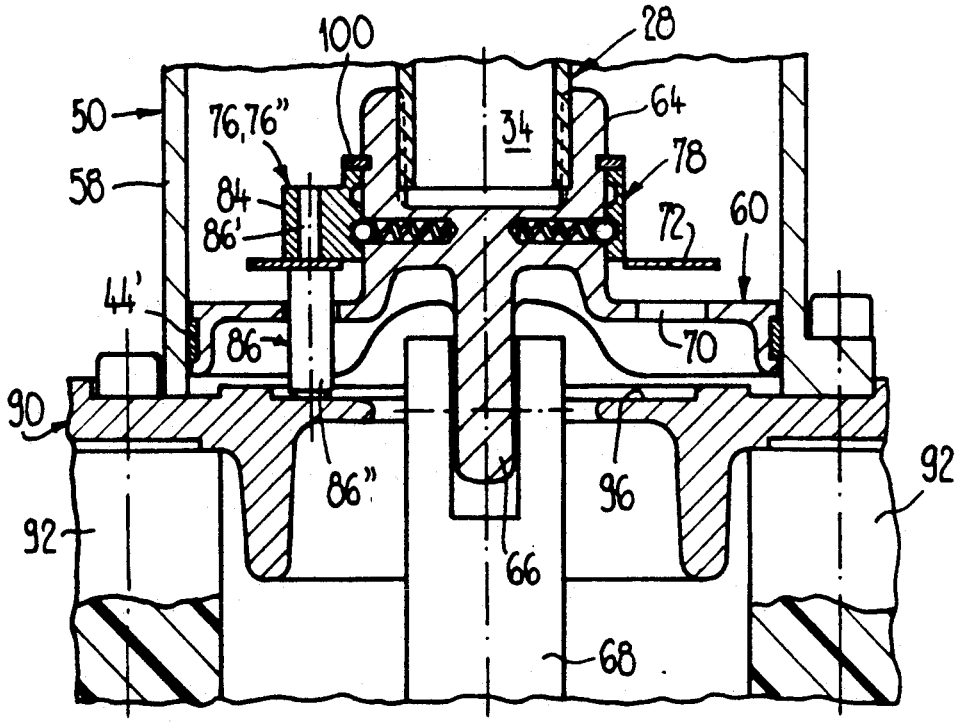
FIG. 6 schematically shows in a view corresponding to that in FIG. 4 a part or portion of the second exemplary embodiment of the gas-blast circuit breaker constructed according to the invention.

With the exception of two hereinafter described design or structural differences, the second exemplary embodiment of the gas-blast circuit breaker only partially depicted in FIGS. 5 and 6 corresponds with the first exemplary embodiment illustrated in FIGS. 1 through 4 and hereinabove described in all detail. In FIGS. 5 and 6, there have been generally used the same reference characters and numerals to denote the same or analogous components of the first exemplary embodiment illustrated in FIGS. 1 through 4.

FIG. 5 shows in a view corresponding to that in FIG. 3 the region of the piston 60 in the closed position of the gas-blast circuit breaker. FIG. 6 shows in a view corresponding to that in FIG. 4 the region of the piston 60 in the open position of the gas-blast circuit breaker. At the neck or collar 64 projecting from the piston 60 in the upward direction, the annular actuating or operating element 76 is displaceably mounted for movement in the axial direction. The snap-in locking device 78 defines the lower first lock-in position 76' (FIG. 5) and the upper second lock-in position 76'' (FIG. 6) for the annular actuating or operating element 76. The shafts or shanks 86 mounted at the respective noses or lugs 84 piercingly extend through the disk-type annular valve body 72 as well as through the piston 60, and firmly retain the disk-type annular valve body 72 to be immobile in relation to the annular actuating element 76, the disk-type annular valve body 72 being clamped between the noses 84 and the step resulting from the difference in diameter of the shaft portions 86' and 86''. When the annular actuating element 76 is in its lower first lock-in position 76' (FIG. 5), the large-surface inlet or admission openings 70 of the piston 60 are closed by the disk-type annular valve body 72 which is in its closed position 72'. The disk-type annular valve body 72 of the second exemplary embodiment of the gas-blast circuit breaker cannot act as a flutter valve.

In the intermediate base or bottom 48 of the second constant-current contact piece 50 there are provided a number of through-holes 112 connecting the ambient space 94 with the blow-out space 40. These through-holes 112 are provided with respective check valves 114 closing the latter when excess pressure, in relation to the pressure in the ambient space 94, prevails in the blow-out space 40. These check valves 114 thus take over the function of the disk-type annular valve body 72 acting as a flutter valve in the first exemplary embodiment of the gas-blast circuit breaker according to FIGS. 1 through 4. For reasons of completeness, it is to be remarked that a ring space, which is delimited by the intermediate base or bottom 48 and the stationary annular pumping piston 42 as well as by the second constant-current contact piece 50 and the supporting tube 46 and into which the through-holes 112 open, communicates with the ambient space 94 through radial openings 116 provided in the second constant-current contact piece 50.

Having now had the benefit of the foregoing description of the exemplary embodiments of the gas-blast circuit breaker as considered with respect to FIGS. 1 through 6, the mode of operation of the gas-blast circuit breaker constructed according to the invention is hereinafter described and is as follows:

In the closed position of the gas-blast circuit breaker depicted in FIGS. 1, 3 and 5, the annular actuating or operating element 76 assumes its lower first lock-in position 76', so that the disk-type annular valve body 72 is in its closed position, in which the large-surface inlet openings 70 are closed. The current flows for the most part from the terminal 14 through the stationary constant-current contact piece 12 and via the constant-current contact fingers 110 to the metallic pumping cylinder 20. Current conduction continues from the metallic pumping cylinder 20 via the crown-like sliding contact piece 102 onto the second constant-current contact piece 50 and through the terminal flange 52 to the other not particularly illustrated terminal of the gas-blast circuit breaker. The remaining smaller part of the current flows through the stationary contact piece 10 to the tulip contact 30 and via the base 18 to the metallic cylinder jacket 20' From the cylinder jacket 20', this part of the current flows along the aforedescribed current path to the other not particularly illustrated circuit-breaker terminal.

When the movable contact maker 28 is shifted by the driving or operating mechanism 67 from its closed position (FIGS. 1, 3 and 5) to its open position (FIGS. 2, 4 and 6), thereby covering the distance defined by the downward opening stroke, the constant-current contact fingers 110 are separated from the metallic cylinder jacket 20' to begin with, so that the entire current commutates into the stationary contact piece 10 and the tulip contact 30. During the following separation of the tulip contact 30 from the stationary contact piece 10, an arc is established, toward which a flow of pressure gas compressed in the pumping space 26 by the relative motion between the metallic pumping cylinder 20 and the stationary annular pumping piston 42 is directed until the arc is extinguished. A part of the compressed gas thereby flows through the blast nozzle 16 into the ambient space 94, while the other part flows through the passage or duct 36 of the movable contact maker 28 into the blow-out space 40.

During currentless or no-load interruption as well as during the interruption of relatively low-amperage currents, the compressed gas is not heated or very slightly heated, so that a negative pressure in the blow-out space 40 relative to the ambient space 94 tends to build up, since in the first place not all compressed gas forced out of the pumping space 26 flows into the blow-out space 40 and, in the second place, the blow-out space 40 is augmented or enlarged to a greater extent than that to which the pumping space 26 is reduced in size, because the active area or surface of the piston 60 is larger than the active area or surface of the stationary annular pumping piston 42. However, the build-up of negative pressure in the blow-out space 40 is precluded in that, in the exemplary embodiment according to FIGS. 1 through 4, the disk-type annular valve body 72 acts as a flutter valve connecting the ambient space 94 with the blow-out space 40 and, in the exemplary embodiment according to FIGS. 5 and 6, the check valves 114 open in order to likewise flow-connect the ambient space 94 with the blow-out space 40. Since in this case no negative pressure can build up in the blow-out space 40, the driving or operating mechanism 67 is required to perform no more work than would be the case in a gas-blast circuit breaker without the blow-out space 40.

During medium-current and heavy-current interruption, the compressed gas forced out of the pumping space 26 is intensively heated. As a result, an overpressure is built up in the blow-out space 40 relative to the pressure in the ambient space 94. The disk-type annular valve body 72 thus remains in its closed position 72' and, in the exemplary embodiment according to FIGS. 5 and 6, the check valves 114 are closed. The driving or operating mechanism 67 is thus assisted by the overpressure prevailing in the blow-out space 40 during interruption in the medium-current and relatively heavy-current range.

Towards the end of the downward opening stroke, the shafts 86 come to rest at the first stop face or surface 96. As a result, the annular actuating or operating element 76 operatively associated and co-moving with the piston 60 is upwardly shifted from the lower first lock-in position 76' into the upper second lock-in position 76'' thereof (FIGS. 2, 4 and 6). In this manner, the disk-type annular valve body 72 is brought into its open position 72'' and retained thereat.

During the closing operation or process, in which the movable contact maker 28 together with the blast nozzle 16, the metallic pumping cylinder 20, the piston 60 and the annular actuating element 76 operatively associated with the latter are moved in the upward direction, the pumping space 26 is enlarged and the blow-out space 40 is reduced in size. The disk-type annular valve body 72, which is forcibly retained in its open position 72'' by the annular actuating element 76 locked in the upper second lock-in position 76'' thereof, keeps the inlet or admission openings 70 open, so that no overpressure can build up in the blow-out space 40. Consequently, during the closing process, the driving or operating mechanism 67 has no additional driving force to exert in comparison with a gas-blast circuit breaker having no such space as the blow-out space 40. The low or negative pressure in the pumping space 26 is compensated by aspiration of compressed gas through the port or entrance 22 of the blast nozzle 16 as well as through the aspiration passages 54 released under these prevailing pressure conditions by the ring-shaped check-valve body 56.

Towards the end of the closing operation or process, the noses or lugs 84 abut against the second stop face or surface 98. As a result, the annular operating or actuating element 76 is downwardly shifted from its upper second lock-in position 76'' back to the lower first lock-in position 76' thereof. In this manner, the disk-type annular valve body 72 is transferred from the open position 72'' thereof, which it assumed during the closing operation or process, into the respective closed position 72'. Prior to the outset of the opening or tripping operation or process, the disk-type valve body 72 is thus always in the closed position 72' thereof.

The gas-blast circuit breaker constructed according to the invention assists the driving or operating mechanism 67 during the interruption of medium-amperage and relatively high-amperage currents, and requires of the driving mechanism 67 during the interruption of low-amperage currents as well as during the closing operation or process no more driving effort or force than in a gas-blast circuit breaker having no such blow-out space 40, without thereby adversely affecting the arc quenching or extinguishing behavior. The gas-blast circuit breaker constructed according to the present invention thus gets by with a driving or operating mechanism 67 of relatively low driving energy.

It is also conceivable that the disk-type annular valve body 72 is fixedly arranged at the annular actuating or operating element 76, as depicted in FIGS. 5 and 6, and that the through-holes 112 can be dispensed with, but in that case, during no-load operation or during low-current interruption, a negative pressure is built up in the blow-out space 40. This can accelerate arc quenching and current-flow interruption, but certainly requires additional operating energy of the driving or operating mechanism 67.

It is obvious that the snap-in locking device 78 may be otherwise embodied and realized by means of other equivalent structures. Thus, for example, it is conceivable that the annular actuating element 76 is retained in the lock-in positions 76' and 76'' by respective magnetic means. Furthermore, it is also readily conceivable that the annular actuating element 76 is brought from the one lock-in position into the other lock-in position only in the closed position or, as the case may be, in the open position of the gas-blast circuit breaker. Of course, it would also be possible to provide the snap-in locking device 78 or equivalent structure for the annular actuating or operating element 76 at the blow-out or exhaust pipe 32 of the movable contact maker 28.

While there are shown and described present preferred embodiments of the invention, it is to be distinctly understood that the invention is not limited thereto, but may be otherwise variously embodied and practiced within the scope of the following claims.

Accordingly, What is claimed is:

1. A gas-blast circuit breaker performing a closing operation and an opening operation to assume a closed-circuit position and an open-circuit position, respectively, comprising:

an ambient space comprising a quenching gas;

a stationary contact piece;

a movable contact maker having oppositely situated ends;

said stationary contact piece and said movable contact maker being arranged in said ambient space;

a blast nozzle penetrated by said stationary contact piece in the closed-circuit position;

one of said oppositely situated ends of said movable contact maker forming a free end thereof;

said movable contact maker being provided with an axial passage starting at said free end and being surrounded by said blast nozzle;

the opening operation entailing an opening stroke of said movable contact maker;

a pumping space delimited by a pumping cylinder and a pumping piston and pressurizable during said opening stroke;

said blast nozzle having a port which communicates with said pumping space;

said axial passage opening into a blow-out space at the other one of said oppositely situated ends of said movable contact maker;

a cylinder;

a piston operatively associated with said movable contact maker for co-movement therewith;

said blow-out space being delimited by said cylinder and said piston;

controlled valve means rendering possible that said blow-out space is connectable with said ambient space during the closing operation; and control means provided for opening said controlled valve means towards the end of said opening stroke and for retaining said controlled valve means open until during the closing operation the closed-circuit position is substantially reached.

2. The gas-blast circuit breaker as defined in claim 1, wherein:

said piston operatively associated with said movable contact maker for movement therewith has a predetermined direction of travel;

said controlled valve means comprise a valve body;

said control means comprise an actuating element movable in said predetermined direction of travel of said piston and controllable to act upon said valve body;

said control means further comprise a snap-in locking device having a first lock-in position and a second lock-in position for said actuating element;

said valve body of said controlled valve means having a closed position corresponding with said first lock-in position and an open position corresponding with said second lock-in position;

first stop means;

said actuating element being displaceable from said first lock-in position into said second lock-in position by bearing against said first stop means towards the end of said opening stroke;

second stop means; and the closing operation from said second lock-in position into said first lock-in position by bearing against said second stop means shortly before reaching the closed-circuit position.

3. The gas-blast circuit breaker as defined in claim 2, wherein:

said first stop means and said second stop means are stationary.

4. The gas-blast circuit breaker as defined in claim 3, further including:

drag connection means for coupling said valve body with said actuating element such that said valve body in said first lock-in position corresponding with said closed position thereof forms a flutter valve having free passage in the direction from said ambient space into said blow-out space.

5. The gas-blast circuit breaker as defined in claim 2, further including:

drag connection means for coupling said valve body with said actuating element such that said valve body in said first lock-in position corresponding with said closed position thereof forms a flutter valve having free passage in the direction from said ambient space into said blow-out space.

6. The gas-blast circuit breaker as defined in claim 2,, wherein:

said actuating element is arranged within said blow-out space and structured to have a substantially ring-shaped configuration encompassing said movable contact maker;

said actuating element is provided with two detent grooves; and said snap-in locking device is arranged in said movable contact maker and comprises a spring-biased snap-in member co-acting respectively with said two detent grooves provided at said actuating element.

7. The gas-blast circuit breaker as defined in claim 6, wherein:

said spring-biased snap-in member in a spring-biased ball.

8. The gas-blast circuit breaker as defined in claim 6, wherein:

said first stop means is located externally of said blow-out space;

said actuating element comprises counterstop means piercingly extending through said piston and co-acting with said first stop means provided externally of said blow-out space; and said second stop means is provided in said blow-out space.

9. The gas-blast circuit breaker as defined in claim 2, wherein:

said snap-in locking device comprises magnetic means serving to retain said actuating element in said first lock-in position or, as the case may be, in said second lock-in position.

10. The gas-blast circuit breaker as defined in claim 1, wherein:

said piston operatively associated with said movable contact maker for co-movement therewith is provided with inlet openings;

said controlled valve means comprise a valve body; and said valve body co-acting with said piston for the purpose of releasably closing said inlet openings provided in said piston.

11. The gas-blast circuit breaker as defined in claim 10, wherein:

said valve body of said controlled valve means constitutes a disk-type annular valve body.

12. The gas-blast circuit breaker as defined in claim 10, wherein:

said piston has a predetermined direction of travel;

said control means comprise an actuating element movable in said predetermined direction of travel of said piston and controllable to act upon said valve body co-acting with said piston;

said actuating element being arranged in said blow-out space and structured to have a substantially ring-shaped configuration encompassing said movable contact-maker;

said actuating element being provided with two detent grooves;

said valve body having a closed position and an open position;

said control means further comprise a snap-in locking device being arranged in said movable contact maker and comprising a spring-biased snap-in member co-acting respectively with said two detent grooves to define a first lock-in position corresponding with said closed position of said valve body and a second lock-in position corresponding with said open position of said valve body;

means defining a first impact location and a second impact location; and said actuating element being displaceable from said first lock-in position into said second lock-in position by impaction at said first impact location towards the end of said opening stroke and displaceable during the closing operation from said second lock-in position into said first lock-in position by impaction at said second impact location shortly before reaching the closed-circuit position.

13. The gas-blast circuit breaker as defined in claim 12, wherein:

said spring-biased snap-in member is a spring-biased ball.

14. The gas-blast circuit breaker as defined in claim 12, wherein:

said first impact location is provided externally of said blow-out space;

said actuating element comprises counterstop means piercingly extending through said inlet openings of said piston and co-acting with said first impact location provided externally of said blow-out space, and said second impact location is provided in said blow-out space.

15. The gas-blast circuit breaker as defined in claim 10, wherein:

said piston has a predetermined direction of travel;

said control means comprise an actuating element movable in said predetermined direction of travel of said piston and controllable to act upon said valve body co-acting with said piston;

said actuating element being arranged in said blow-out space and structured to have a substantially ring-shaped configuration encompassing said movable contact maker;

said actuating element being provided with two detent grooves;

said valve body having a closed position and an open position;

said control means further comprise a snap-in locking device being arranged in said movable contact maker and comprising a spring-biased snap-in member co-acting respectively with said two detent grooves to define a first lock-in position corresponding with said closed position of said valve body and a second lock-in position corresponding with said open position of said valve body;

means defining a first impact location and a second impact location; and said actuating element being displaceable from said first lock-in position into said second lock-in position by impacting at said first impact location at the end of said opening stroke and displaceable during the closing operation from said second lock-in position into said first lock-in position by impaction at said second impact location upon reaching the closed-circuit position.

16. The gas-blast circuit breaker as defined in claim 10, wherein:

said piston comprises a neck formed thereat and has a predetermined direction of travel;

said control means comprise an actuating element movable in said predetermined direction of travel of said piston and controllable to act upon said valve body co-acting with said piston;

said actuating element being displaceable from said first lock-in position into said second lock-in position by impaction at said first impact location towards the end of said opening stroke, and displaceable during the closing operation from said second lock-in position into said first lock-in position by impaction at said second impact location shortly before reaching the closed-circuit position.

17. The gas-blast circuit breaker as defined in claim 16, wherein:

said spring-biased snap-in member is a spring-biased ball.

18. The gas-blast circuit breaker as defined in claim 16, wherein:

said first impact location is located externally of said blow-out space;

said actuating element comprises counterstop means piercingly extending through said inlet openings in said piston and co-acting with said first impact location provided externally of said blow-out space; and said second impact location being provided in said blow-out space.

19. The gas-blast circuit breaker as defined in claim 10, wherein:

said piston comprises a neck formed thereat and has a predetermined direction of travel;

said control means comprise an actuating element movable in said predetermined direction of travel of said piston and controllable to act upon said valve body co-acting with said piston;

said actuating element being arranged in said blow-out space and structured to have a substantially ring-shaped configuration encompassing said neck of said piston;

said actuating element being provided with two detent grooves;

said valve body having a closed position and an open position;

said control means further comprise a snap-in locking device being arranged in said neck of said piston and comprising a spring-biased snap-in member co-acting respectively with said two detent grooves to define a first lock-in position corresponding with said closed position of said valve body and a second lock-in position corresponding with said open position of said valve body;

means defining a first impact location and a second impact location; and said actuating element being displaceable from said first lock-in position into said second lock-in position by impaction at said first impact location towards the end of said opening stroke, and displaceable during the closing operation from said second lock-in position into said first lock-in position by impaction at said second impact location shortly before reaching the closed-circuit position.

20. The gas-blast circuit breaker as defined in claim 1, further including:

check-valve means having free passage in the direction from said ambient space into said blow-out space; and said blow-out space being connected with said ambient space by means of said check-valve means.

21. The gas-blast circuit breaker as defined in claim 1, wherein:

said piston operatively associated with said movable contact make for movement therewith has a predetermined direction of travel;

said controlled valve means comprise a valve body;

said control means comprise an actuating element movable in said predetermined direction of travel of said piston and controllable to act upon said valve body;

said control means further comprise a snap-in locking device having a first lock-in position and a second lock-in position for said actuating element;

said valve body of said controlled valve means having a closed position corresponding with said first lock-in position and an open position corresponding with said second lock-in position;

first stop means;

said actuating element being displaceable from said first lock-in position into said second lock-in position by bearing against said first stop means at the end of said opening stroke;

second stop means; and said actuating element being displaceable during the closing operation form said second lock-in position into said first lock-in position by bearing against said second stop means upon reaching the closed-circuit position.

22. The gas-blast circuit breaker as defined in claim 21, wherein:

said first stop means and said second stop means are stationary.

23. The gas-blast circuit breaker as defined in claim 22, further including:

drag connection means for coupling said valve body with said actuating element such that said valve body in said first lock-in position corresponding with said closed position thereof forms a flutter valve having free passage in the direction from said ambient space into said blow-out space.

24. The gas-blast circuit breaker as defined in claim 21, further including:

drag connection means for coupling said valve body with said actuating element such that said valve body in said first lock-in position corresponding with said closed position thereof forms a flutter valve having free passage in the direction from said ambient space into said blow-out space.

25. The gas-blast circuit breaker as defined in claim 21, wherein:

said piston comprises a neck formed thereat;

said actuating element is arranged within aid blow-out space and structured to have a substantially ring-shaped configuration encompassing said neck of said piston;

two detent grooves are provided at said actuating element; and said snap-in locking device is arranged in said neck of said piston and comprises a spring-biased member co-acting respectively with said two detent grooves provided at said actuating element.

26. The gas-blast circuit breaker as defined in claim 25, wherein:

said spring-biased snap-in member is a spring-biased ball.

27. The gas-blast circuit breaker as defined in claim 25, wherein:

said first stop means is located eternally of said blow-out space;

said actuating element comprises counterstop means piercingly extending through said piston and co-acting with said first stop means provided externally of said blow-out space; and said second stop means is provided in said blow-out space.

28. The gas-blast circuit breaker as defined in claim 21, wherein:

said snap-in locking device comprises magnetic means serving to retain said actuating element in said first lock-in position or, as the case may be, in said second lock-in position.

* * * * *